United States Patent [19]

Liston

[11] Patent Number: 5,034,862

[45] Date of Patent: Jul. 23, 1991

[54] MULTI-POSITION FLASHLIGHT HOLDER

[76] Inventor: James W. Liston, 1923 Wilson Ave., Salt Lake City, Utah 84108

[21] Appl. No.: 510,588

[22] Filed: Apr. 18, 1990

[51] Int. Cl.[5] ..... F21L 15/14

[52] U.S. Cl. ..... 362/105; 362/191

[58] Field of Search ..... 362/103, 105, 106, 190, 362/191; 2/209.21; 224/181; D26/39

[56] References Cited

U.S. PATENT DOCUMENTS

| | | | |
|---|---|---|---|
| 1,318,850 | 10/1919 | Deyong . | |
| 1,530,402 | 3/1925 | Parker . | |
| 1,540,372 | 6/1925 | Scars . | |
| 2,263,577 | 11/1941 | Griner . | |
| 3,240,271 | 5/1966 | Allbritton | 224/25 |
| 3,542,041 | 11/1970 | Mercorella | 132/46 |
| 3,634,676 | 1/1972 | Castellano . | |
| 3,769,663 | 11/1973 | Perl | 24/81 AD |
| 4,236,658 | 12/1980 | Kallman | 224/250 |
| 4,360,930 | 11/1982 | Blanchard | 2/209.2 |
| 4,462,064 | 7/1984 | Schweitzer | 362/105 |
| 4,462,068 | 7/1984 | Shadwick | 362/332 |
| 4,521,831 | 6/1985 | Thayer | 362/32 |
| 4,718,126 | 1/1988 | Slay | 2/175 |
| 4,794,496 | 12/1988 | Lanes et al. | 362/10.5 |
| 4,797,793 | 1/1989 | Fields | 362/105 |
| 4,970,631 | 11/1990 | Marshall | 362/105 |

*Primary Examiner*—Stephen F. Husar

*Attorney, Agent, or Firm*—Thorpe, North & Western

[57] ABSTRACT

A headband for use in holding a flashlight to the side of a user's head. The headband including a plurality of strap sets. Each strap set functioning to hold the barrel of a flashlight in a predetermined orientation so as to cause the flashlight beam to be directed generally along the user's line of sight. Each strap set may be formed of a plurality of straps each forming openings having coinciding central axes. Each strap set being attached to the headband at approximately the central section thereof. Individual straps forming a strap set may be attached to the headband at locations between individual straps of other strap sets thereof so as to allow a plurality of strap sets to be located generally in the same location on the central portion of the headband in order to avoid the necessity of the user readjusting the headband on his or her head when reorientation of the flashlight becomes necessary.

3 Claims, 3 Drawing Sheets

MULTI-POSITION FLASHLIGHT HOLDER

BACKGROUND OF THE INVENTION

1) Field of the Invention

The present invention relates to a holding device; specifically, a flashlight holding device which is attachable about the body of a user.

2) Background Information

It has been known in the prior art to provide a flashlight holding apparatus attachable about the user's head for allowing the user to direct the beam of the flashlight by movement of the head only, thus allowing for hands-free operation.

U.S. Pat. No. 4,797,793 to FIELDS and U.S. Pat. No. 4,718,126 to SLAY, show headbands used for retaining flashlights. FIELDS specifically discloses a headband made of elastic material which has its ends sewn together in such a manner that a pocket is formed between the overlap thereof into which a barrel of a flashlight can be inserted. SLAY discloses a strap made of elastic material for encircling the head. The strap having affixed therearound a broad band which is arranged so as to define a hole therebetween and the strap into which the barrel of the flashlight may be inserted.

It has been a problem in the past with prior art headband type flashlight holders to correctly orient the flashlight in the headband so as to both allow the headband to be comfortably placed around the head, and also allow the beam of the flashlight to shine the desired direction. Prior art attempts to solve this problem have resulted in flashlight retaining arrangements which are of complicated and unsatisfactorily effective construction. Examples of adjustable headband type holders are U.S. Pat. No. 1,318,850. None of these prior art flashlight retaining arrangements is as efficient as the multi-positioned flashlight retaining headband of the present invention described below.

SUMMARY OF THE INVENTION

It is an object of the present invention to devise a tool holder which is attachable to a user's body.

Is another object of the present invention to provide a tool holder which allows for attachment of a tool thereto in a plurality of orientations.

It is further an object of the present invention to provide a tool holder capable of securely holding a flashlight next to a user's head in a plurality of orientations relative to the holder so as to allow the user to position the flashlight on the holder in any one of a plurality of orientations relative thereto in order to allow the flashlight to shine in a direction most convenient to the user.

It is another object of the present invention to provide a flashlight holder as explained above which is simple in design and inexpensive to manufacture.

It is further an object of the present invention to provide a flashlight holder as defined above which is also adaptable to a wide range of head sizes.

It is still further an object of the present invention to provide a flashlight holder that is lightweight, small in size, easily adjustable, and easy to use.

These and other objects are realized in an embodiment of the invention specifically described below which includes an apparatus which holds a tool such as a flashlight about a portion of the user's body, such as the user's head, the apparatus comprising an elongated strap which is intended to encircle the user's head so as to pass therearound above the eyes at the level of the user's forehead and slightly above the user's ears, the elongated strap being made of an elastic material which allows it t stretch along its length but prevents stretching along its width, the ends of the elongated bands including hook and loop type fastening material such as Velcro or elasticized Velcro; and a strap or set of straps attached approximately at the central regions of the headband on one side thereof, the strap or straps being formed of an elastic material, each end of each strap being sewed or attached by means of a VELCRO covered plate to the headband, each strap thereby being stretchable to form an opening, either entirely of itself or in conjunction with the headband or plate, through which the barrel of a flashlight may be inserted; the opening formed by each strap, if desired, having a longitudinal axis which coincides with the longitudinal axis of an opening in at least one other strap, such coinciding straps constituting a strap set which functions to hold the barrel of a flashlight in a predetermined orientation, the headband allowing a plurality of these straps or strap sets to be included thereon; each strap or straps having the longitudinal axis defined by the openings in the straps thereof and the longitudinal axis of each strap set being oriented differently than that of each other strap set, the headband also being capable of including single straps which are interlocated between strap sets if desired.

The present invention is used by inserting a barrel of a flashlight into a strap or strap set, thus fixing the flashlight in a predetermined orientation relative to the headband, the headband being placed around the user's head such that the flashlight will be located approximately above one of the user's ears so as to be able to shine in a direction approximately parallel with the user's line of sight, the ends of the headband meeting approximately over the user's opposite ear and being attached together by the hook and loop fastening material.

Should the user desire the flashlight to be reoriented so that the flashlight is capable of shining in a direction parallel to a different line of sight, the user need merely remove the flashlight from the strap or strap set in which it is presently secured, and replacing the flashlight barrel into a second strap or strap set which will fix the flashlight in a different orientation relative to the headband, or alternatively, the user may reorient the flashlight by separating the VELCRO plate from the headband and reorienting the plate relative thereto before reattaching it. In either case, the user thus is able to reorient the flashlight while the headband remains in its original orientation and location on the user's head.

Due to the use of a plurality of elasticized straps to form a strap set, each strap set may be located at approximately the same location on the headband (in fact, individual straps, or straps constituting a strap set, may be located in between straps constituting a second strap set) without causing interference with the use of any of the straps. This allows the user to choose a particular orientation of a flashlight by inserting it in a particular strap or strap set without interference being caused by other straps or strap sets, even though portions of one strap set are located in between portions of another strap set. This design allows each strap or strap set to be located generally at the same position on the headband.

This unique design allows the user to reorient the flashlight by utilizing a different strap or strap set while avoiding the need to move the headband so that the flashlight remains located over the user's ear. Thus the flashlight remains capable of shining in a direction parallel to the user's line of sight regardless of the strap or straps being used to hold the light and without the need to readjust the headband on the head.

These and other objects, advantages and features of the invention will become apparent from the following description of a preferred embodiment, considered along with the accompanying drawings in which like numerals represent similar elements in each drawing.

DETAILED DESCRIPTION OF THE PREFERRED EMBODIMENT

Figure 1:
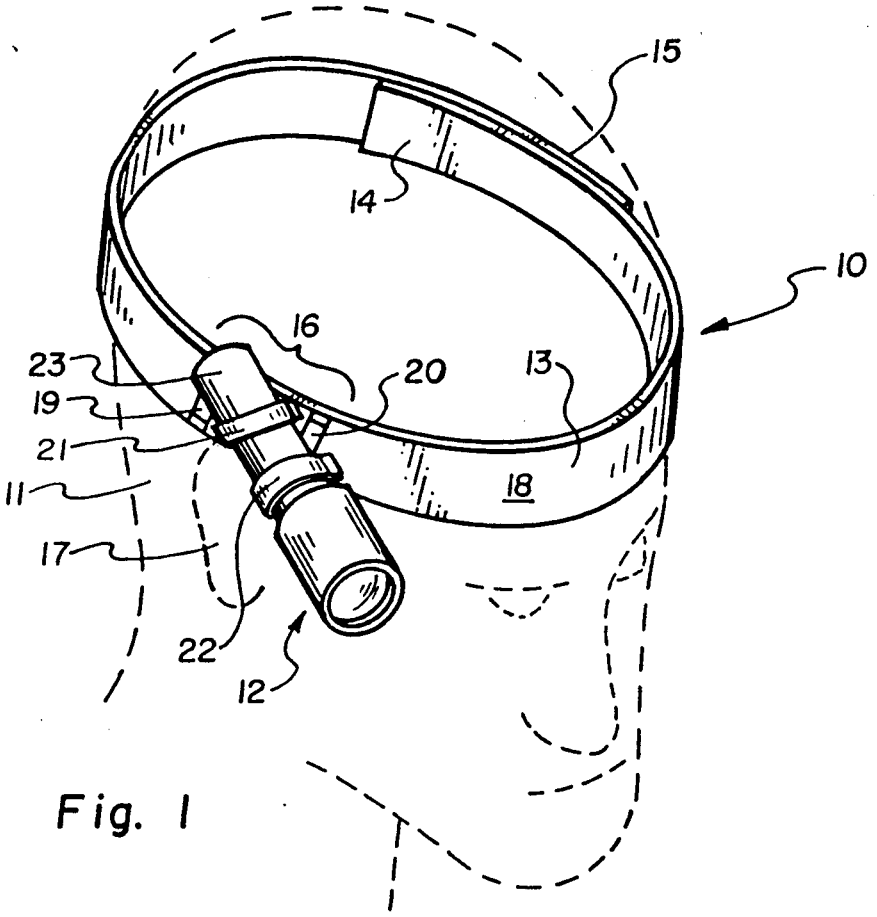
FIG. 1 is a perspective view of a flashlight holder in accordance with the invention being worn on a user's head.

FIG. 1 shows the tool holding apparatus 10 of the present invention positioned around the head 11 of the user. The tool holding apparatus 10 includes a headband 13 formed in an elongated rectangular shape and including a first end 14 and a second end 15 which are adjustably attachable together to fit the headband 13 to the user's head 11. The headband 13 is formed of a stretchable or elasticized material if desired to ensure a snug fit about the user's head 11. Preferably, the elasticized material allows headband 13 to stretch in its elongated direction, but is not stretchable in the direction of the width thereof.

The headband 13 has a central section 16 which is located generally halfway between the first and second ends 14 and 15 thereof. The central section 16 is intended to be located directly above one of the user's ears 17 when the apparatus 10 is correctly fitted in place on the user's head 11. Within the central section 16, on the outer surface 18 of the headband 13, a plurality of straps 19, 20, 21 and 22 are attached as by sewing or otherwise attaching the ends thereof so as to form a loop or opening. The opening formed may be formed entirely of the strap (such as is shown by the attachment of strap 22) or may be formed partially by the strap and the exterior surface 18 of the headband 13. Straps 19, 20 and 21 are each attached to the exterior surface 18 of the headband 13 in two separate locations thus causing the strap 19, 20 or 21 to form half of the opening and exterior surface 18 to form the other half thereof.

As can be seen in FIG. 1, the straps 21 and 22 are used in conjunction to secure the barrel 23 of a flashlight in the openings formed thereby in such a manner that the lens 24 of the flashlight can shine generally in the direction of the line of sight of the user.

The central axis of the opening formed by strap 22 is aligned with the central axis of the opening partially formed by strap 21. Because the openings of straps 21 and 22 are in such alignment, the linear cylindrical-shaped barrel 23 of the flashlight 12 can be passed through both of the openings thus allowing straps 21 and 22 to function as a set. The set of straps 21 and 22 causing the flashlight to be oriented so as to shine in a direction which coincides with the central axis of the openings formed thereby.

Straps 19 and 20 also operate as a set and form openings having coinciding central axis through which the barrel 23 of flashlight 12 may be inserted to cause the flashlight 12 to shine along the central axis defined by the straps 19 and 20.

Figure 2:
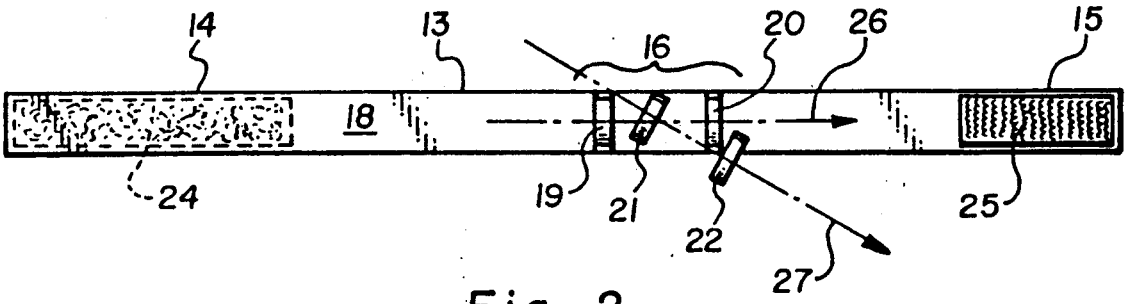
FIG. 2 is a plan view of the headband formed in accordance with the principles of the present invention.

As can be seen in FIG. 2, ends 14 and 15 of the headband 13 may have attached thereto the well-known type hook and pile fastening members 24 and 25. The hook and pile fastening members 24 and 25 may also be formed of an elasticized material if desired.

The central axes of the openings formed by straps 19 and 20 are colinear and shown by arrow 26. As can be seen, the arrow 26 of straps 19 and 20 is directed along the longitudinal axis of the band 13. The central axes of the openings formed by straps 21 and 22 are also colinear and are shown by arrow 27. As can be seen, the strap set which includes straps 21 and 22 will direct the beam of a flashlight 12 at an angle from the longitudinal axis of band 13.

Although the band 13 of the present invention is shown attached to head 11 of the user such that the central portion 16 thereof is located slightly above the user's right ear 17, it is of course to be understood that the band 13 may be rotated 180 degrees if desired to place the central section 16 over the user's left ear, or the band may be turned upside down with the central section 16 being located above either ear of the user and causing a 180 degree reorientation of arrow 27 representing the longitudinal axes of straps 21 and 22.

Therefore, as can be readily seen, even though only two strap sets are shown on the preferred embodiment of the apparatus 10 of the present invention, these two strap sets may nevertheless function to secure a flashlight 12 to the user's head 11 in more than only two orientations.

Figure 3:
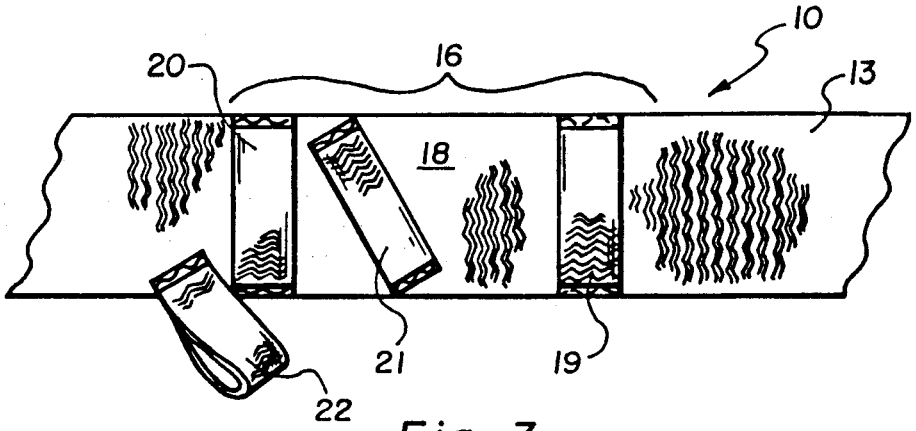
FIG. 3 is a partial plan view of the central portion of the headband formed in accordance with the present invention.

Referring now to FIG. 3 wherein the central section 16 of the headband 13 is shown, it is important to note that due to the relatively small width of each strap 19, 20, 21 and 22, a strap of one strap set may be attached to the exterior surface 18 of the headband at a location between straps, such as straps 19 and 20, of a second strap set. A third strap set, if so desired, could be attached to the exterior surface 18 of the headband 13 in the central section 16 thereof in such a manner that individual straps of the third strap set were located between individual straps of either of the other strap sets as previously defined. Also, single straps, not constituting a portion of any strap set, may be located between individual straps of a strap set if so desired.

This unique ability of the present invention allows several strap sets or individual straps to be located in approximately the same position in the central section 16. Each individual strap or strap set being able to orient a flashlight when placed therein, differently than the orientation of any other strap or strap set.

Figure 4:
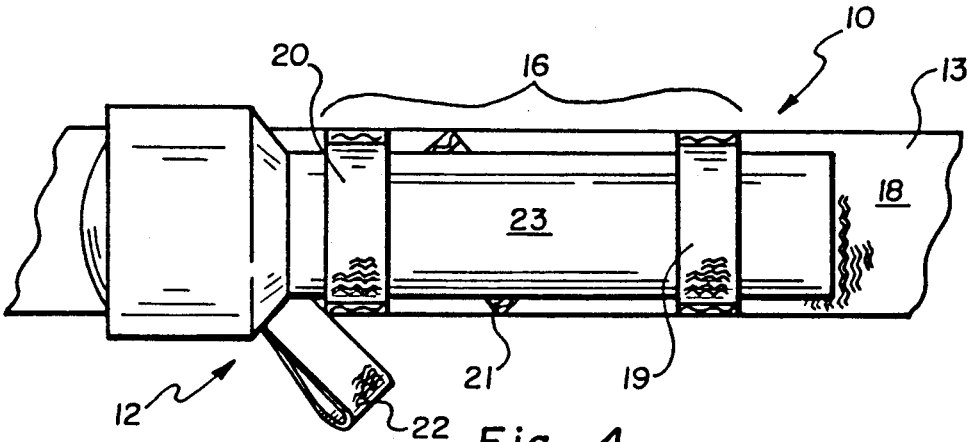
FIG. 4 is a partial plan view of the central portion of the headband formed in accordance with the present invention including a flashlight affixed thereto by a band set.
Figure 5:
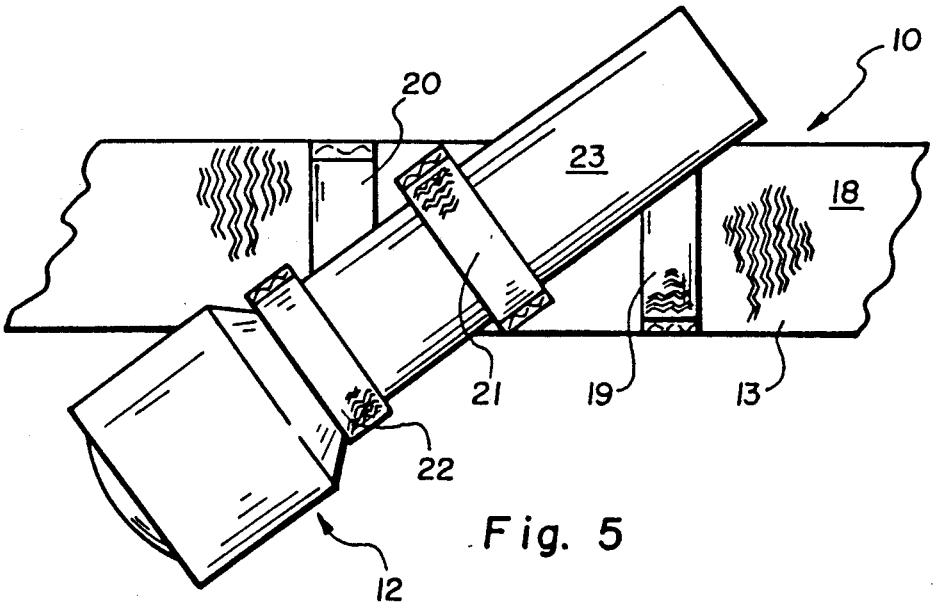
FIG. 5 is a partial plan view of the central portion of the headband of the present invention having a flashlight located in a second set of straps.

Further, as is best seen in FIGS. 4 and 5, a strap or strap set which is not in use, meaning a strap or strap set which is not being used to secure the barrel 23 of a flashlight 12 therein, does not interfere with the flashlight 12 or the strap or strap set which is being used.

Specifically, as seen in FIG. 4, the strap set including straps 19 and 20 is being used to orient the flashlight 12 along the longitudinal axis of the headband 13. Even though strap 21 is located between straps 19 and 20, it is nevertheless not used. Instead, strap 21 is pushed flat against the exterior surface 18 of the band 13 by the barrel 23 of the flashlight 12 and causes no interference.

FIG. 5 shows flashlight 12 inserted in the strap set which includes straps 21 and 22. Again, the barrel 23 of the flashlight 12 pushes against straps 19 and 20 to cause them to lie flush against exterior surface 18 of the band 13. Alternatively, if strap 22 was not present, strap 21 would be used as the only strap to orient the flashlight in its predetermined direction if so desired.

Since several straps or strap sets may be attached to the central section 16 of the band 13 in approximately the same location, a user may reorient the direction of the beam of the flashlight 12 without significantly changing the relative location of attachment of the flashlight 12 along the exterior surface 18 of the band 13. This avoids any necessity of readjusting the headband to keep the flashlight in its proper general position on the side of the user's head 11.

Figure 6:
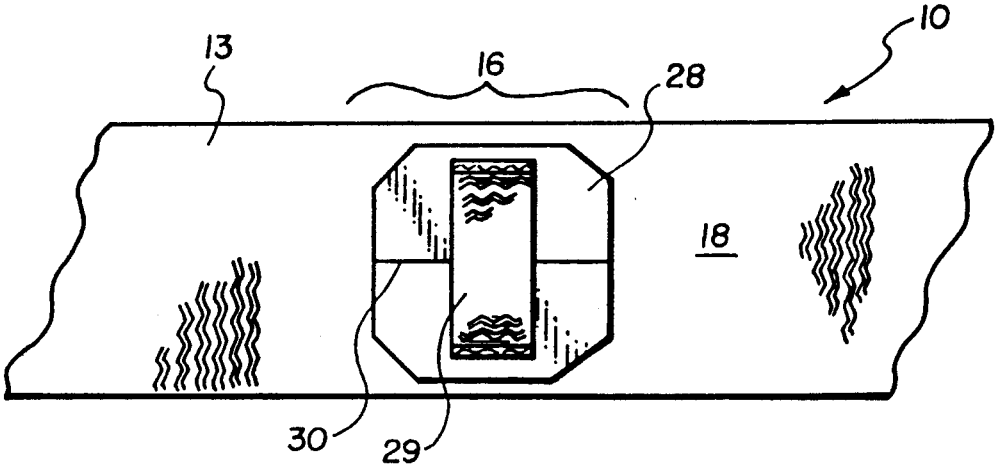
FIG. 6 is a partial plan view of the central portion of the headband formed in accordance with another embodiment of the present invention.
Figure 7:
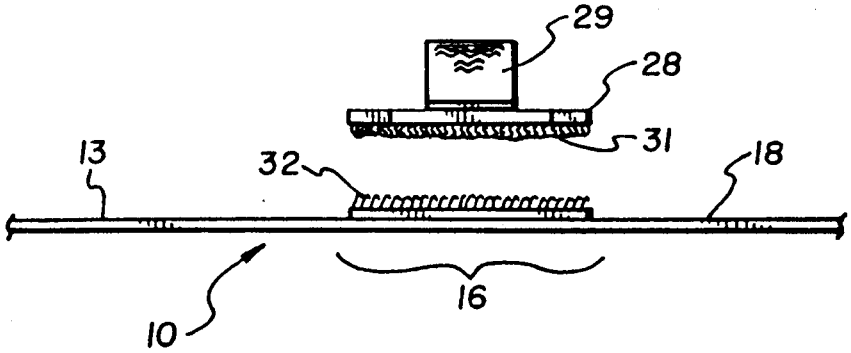
FIG. 7 is a side view of the headband as shown in FIG. 6 with the hook and loop fastener in a separated position.

FIGS. 6 and 7 show an alternative embodiment of the tool holding apparatus of the present invention. In this embodiment, instead of having straps sewn directly to the exterior surface 18 of the headband 13, a plate 28 can be attached to the exterior surface 18 by means of hook and loop fasteners such as VELCRO. The plate 28 would then have attached thereto a strap 29 in the fashion as described above. A flashlight 12 would then be inserted into the strap 29 and held tightly against the plate 28. If desired, a crease such as shown at 30 in FIG. 6 may be formed in the plate 28 in order to cause plate 28 to reconfigure into a very slight V-shape in order to conform to the shape of the flashlight 12.

Hooks 32 may be attached to the exterior surface 18 of the headband 13 at the central portion 16 thereof in any conventional manner such as by sewing. Loops 31 may be attached to the bottom surface of plate 28 also in any conventional manner such as gluing or sewing. In use, the hooks 32 and loops 31 are pressed together to firmly attach the plate 28 to the headband 13.

As shown in FIG. 6, a flashlight if it were inserted into strap 29 would be oriented such that the longitudinal axis thereof would extend along the longitudinal axis of the headband 13. However, should the user decide to reorient the beam of the flashlight, the user need merely remove plate 28 by separating the hook and loop fasteners 31 and 32, and then rotating the plates 28 to the desired orientation relative to headband 13 and then reattaching plate 28. As can obviously be seen, there is no need to remove the flashlight 12 from its attachment in strap 29 in order to cause a reorientation thereof.

It would be considered within the scope of the present application, although not specifically shown in FIG. 6 and 7, to have a plurality of straps 29 attached to a single plate 28 in spaced-apart relationship so as to allow attachment of a flashlight thereto in the manner as described above with strap sets. Also, it is felt to be within the scope of the present invention to attach a plurality of plates 28 to a headband 13 and to use the straps 29 located on each plate 28 either separately or in conjunction so as to form a strap set.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

I claim:

1. A tool holder for use in retaining a flashlight above one ear of the user so as to allow the beam of the flashlight to shine approximately along the user's line of sight, the holder including a headband attachable around the user's head, the improvement comprising:

an elongated band of elasticized material having a central section, a first end, a second end, an exterior face and an interior face, means for attaching said first and second ends of said elongated band, said exterior surface of said central section of said elongated band including a plurality of straps affixed thereto and forming openings sized to encircle the barrel of a flashlight, each of said openings defining a longitudinal axis, the longitudinal axis of at least one strap opening coinciding with a longitudinal axis of at least one other strap opening, said straps having openings with coinciding longitudinal axes defining a strap set, said plurality of straps forming at least one strap set and at least one strap having the longitudinal axis of its opening oriented so as not to coincide with the longitudinal axes of said strap openings included in said at least one strap set.

2. A tool holder according to claim 1 wherein at least one strap of at least one strap set is located on said headband between two straps of a second strap set.

3. A tool holder according to claim 2 wherein at least one strap set includes at least one strap attached at two locations on said headband and at least one strap attached to said headband at only one location.

* * * * *